US007099616B2

(12) United States Patent
Kato et al.

(10) Patent No.: US 7,099,616 B2
(45) Date of Patent: Aug. 29, 2006

(54) HEATING APPARATUS AND IMAGE HEATING APPARATUS

(75) Inventors: Daijiro Kato, Chiba (JP); Koki Watanabe, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 10/862,447

(22) Filed: Jun. 8, 2004

(65) Prior Publication Data

US 2004/0253027 A1 Dec. 16, 2004

(30) Foreign Application Priority Data

Jun. 10, 2003 (JP) ..... 2003-164703

(51) Int. Cl.
*G03G 15/20* (2006.01)

(52) U.S. Cl. ..... 399/328; 219/216; 219/619; 399/334

(58) Field of Classification Search ..... 399/328, 399/330, 320, 334; 219/619; 174/35 CE; 347/156

See application file for complete search history.

(56) References Cited

U.S. PATENT DOCUMENTS

| | | | | |
|---|---|---|---|---|
| 5,240,242 | A | 8/1993 | Ando et al. | 271/118 |
| 6,377,778 | B1 * | 4/2002 | Kikuchi et al. | 399/330 |
| 6,453,144 | B1 * | 9/2002 | Sato | 399/328 |
| 6,477,348 | B1 | 11/2002 | Miyamoto et al. | 399/299 |
| 6,687,481 | B1 * | 2/2004 | Watanabe et al. | 399/328 |
| 2002/0186991 | A1 * | 12/2002 | Watanabe et al. | 399/328 |
| 2003/0021610 | A1 | 1/2003 | Shimizu et al. | 399/44 |
| 2003/0152404 | A1 | 8/2003 | Watanabe et al. | 399/299 |
| 2004/0206750 | A1 * | 10/2004 | Sekiguchi et al. | 219/619 |

FOREIGN PATENT DOCUMENTS

| | | | |
|---|---|---|---|
| JP | 4-166966 | | 6/1992 |
| JP | 5-9027 | B2 | 2/1993 |
| JP | 9-171889 | | 6/1997 |
| JP | 10-74009 | | 3/1998 |
| JP | 2002-083676 | A * | 3/2002 |
| JP | 2003-077645 | A * | 3/2003 |

* cited by examiner

*Primary Examiner*—Sophia S. Chen
(74) *Attorney, Agent, or Firm*—Fitzpatrick, Cella, Harper & Scinto

(57) ABSTRACT

A heating apparatus of an electromagnetic inductive heat generating type using a magnetic flux shield member, the heating apparatus including a coil for generating a magnetic flux, a roller member for generating heat by the magnetic flux from the coil, and heating a material to be heated, the magnetic flux shield member for shielding the magnetic flux from the coil to the roller member to thereby vary the generated heat distribution of the roller member, and a guide member provided in non-contact with the roller member for guiding the movement of the magnetic flux shield member to a predetermined magnetic flux suppressing position, thereby realizing an improvement in the faulty operation of the magnetic flux shield member.

1 Claim, 11 Drawing Sheets

HEATING APPARATUS AND IMAGE HEATING APPARATUS

BACKGROUND OF THE INVENTION

1. Field of the Invention

The invention relates, for example, in an image forming apparatus, to a heating apparatus suitable for use as an image heating apparatus for fixing an unfixed image formed and borne on a recording material, and particularly to a heating apparatus of an electromagnetic (magnetic) induction heating type.

2. Description of Related Art

Description will hereinafter be made with an image heating and fixing apparatus in an image forming apparatus such as an electrophotographic copying machine, a printer or a facsimile apparatus taken as an example.

The image heating and fixing apparatus in the image forming apparatus is an apparatus in which an unfixed toner image formed on the surface of a recording material by a direct process or an indirect (transfer) process is heated and fixed as a permanently secured image on the surface of the recording material in the image forming portion of the image forming portion by suitable image forming process means such as electrophotography, electrostatic recording or magnetic flux recording by the use of a toner (visualizing agent) comprising heat-soluble resin or the like.

There has heretofore been an electromagnetic inductive heating process as the heating process of such an image heating and fixing apparatus. This is an apparatus which uses an electromagnetic inductive heat generating member as a heating member, and causes a magnetic field to act on the electromagnetic inductive heat generating member by magnetic field generating means to thereby impact heat to the recording material as a heated material by joule heat generation based on an eddy current generated in the electromagnetic induction heat generating member, and heat and fix an unfixed toner image on the surface of the recording material.

In Japanese Patent Publication (Koukoku) No. 5-9027 B, there is disclosed an apparatus of a heat roller type in which a fixing roller of a ferromagnetic material is electromagnetically induction-heated, and this apparatus enables a heat generating position to be near to a fixing nip portion, and achieves a fixing process higher in efficiency than an apparatus of a heat roller type using a halogen lamp as a heat source.

This apparatus, however, in great in the heat capacity of the fixing roller and has therefore suffered from the problem that to raise the temperature of the fixing nip portion by limited electric power, great electric power is required.

In Japanese Patent Application Laid-Open No. 4-166966, there is disclosed a fixing apparatus of an electromagnetic inductive heating type using a film-shaped fixing roller reduced in heat capacity.

In the film-shaped fixing roller reduced in heat capacity, however, a heat flow in the longitudinal direction thereof (the lengthwise direction of the fixing nip portion thereof) is impeded and therefore, when a recording material of a small size is passed, an excess temperature rise in a non-paper passing portion (temperature rise of the non-paper passing portion) occurs, and this has given rise to the problem that the life of film or a pressure roller is reduced. This problem of the temperature rise of the non-paper passing portion also holds true in the case of an apparatus of a film heating type.

In Japanese Patent Application Laid-Open No. 10-74009, there is disclosed a heating apparatus characterized by magnetic flux adjusting means for varying the density distribution of an acting magnetic flux with respect to the lengthwise direction of a fixing roller (film). By this fixing apparatus of an electromagnetic inductive heating type, there has been shown a method of solving the temperature rise of the non-paper of solving the temperature rise of the non-paper passing portion. Also, there is disclosed means for moving the magnetic flux adjusting means by predetermined driving means such as a motor or a solenoid, and effecting the adjustment of the magnetic flux of the non-paper passing portion of the fixing roller (film).

Also, in Japanese Patent Application Laid-Open No. 09-171889, it is disclosed to movably provide a magnetic flux shield plate on the inner surface of the cylindrical film guide member of fixing film.

An image forming apparatus using a heating apparatus of the well-known electromagnetic inductive heating type as a fixing apparatus as described above suffers from the following problems.

Magnetic field generating means generates an alternating magnetic flux by an alternating current supplied thereto. In Japanese Patent Application Laid-Open No. 10-74009, magnetic field generating means and magnetic flux shield means are disposed so as to have a clearance therebetween. This has led to the problem that when this alternating magnetic flux acts on the magnetic flux shield means, a repulsive force is born between the magnetic flux shield means and the magnetic field generating means, and the magnetic flux shield means is vibrated to thereby produce a periodic vibration sound.

Also, in a construction wherein the magnetic flux shield means is moved in the interior of the fixing film as in Japanese Patent Application Laid-Open No. 10-74009 and Japanese Patent Application Laid-Open No. 09-171889, the magnetic flux shield means is provided in such a manner as to be along the inner surface of a pressure member (film holder) brought into contact with the fixing film, and this has led to the problem that a fixing pressure force is applied to the holder, whereby the holder is deformed, thus giving rise to the faulty operation of the magnetic flux shield means. This faulty operation of the shield means in turn has led to the problem that the generated heat distribution of an induction heat generating member in a direction orthogonal to the conveying direction of a material to be heated cannot be appropriately controlled and the abnormal temperature rise of the non-paper passing portion is caused. Also, a fixing pressure member (holder) slides in contact with the film and therefore, there has been a problem from the viewpoint of durability.

SUMMARY OF THE INVENTION

It is an object of the present invention to improve the faulty operation of magnetic flux shield means. It is another object of the present invention to provide a heating apparatus, which realizes a reduction in noise resulting from the vibration of the magnetic flux shield means.

The heating apparatus for achieving the above objects has:

a coil for generating a magnetic flux;

a roller member generating heat by the magnetic flux from the coil, a material to be heated being heated by the heat of the roller member; and a magnetic flux shield member for shielding a part of an acting magnetic flux from the coil to the roller member to thereby vary the generated heat distribution of the roller member, the magnetic flux shield member being movable in non-contact with the roller member, wherein guide means for guiding the magnetic flux shield member is provided between the coil and the roller member, the guide means is disposed in non-contact with the roller member, and the magnetic flux shield member is guided between the guide means and the roller member.

DETAILED DESCRIPTION OF THE PREFERRED EMBODIMENTS

First Embodiment (1) Example of an Image Forming Apparatus

Figure 1:
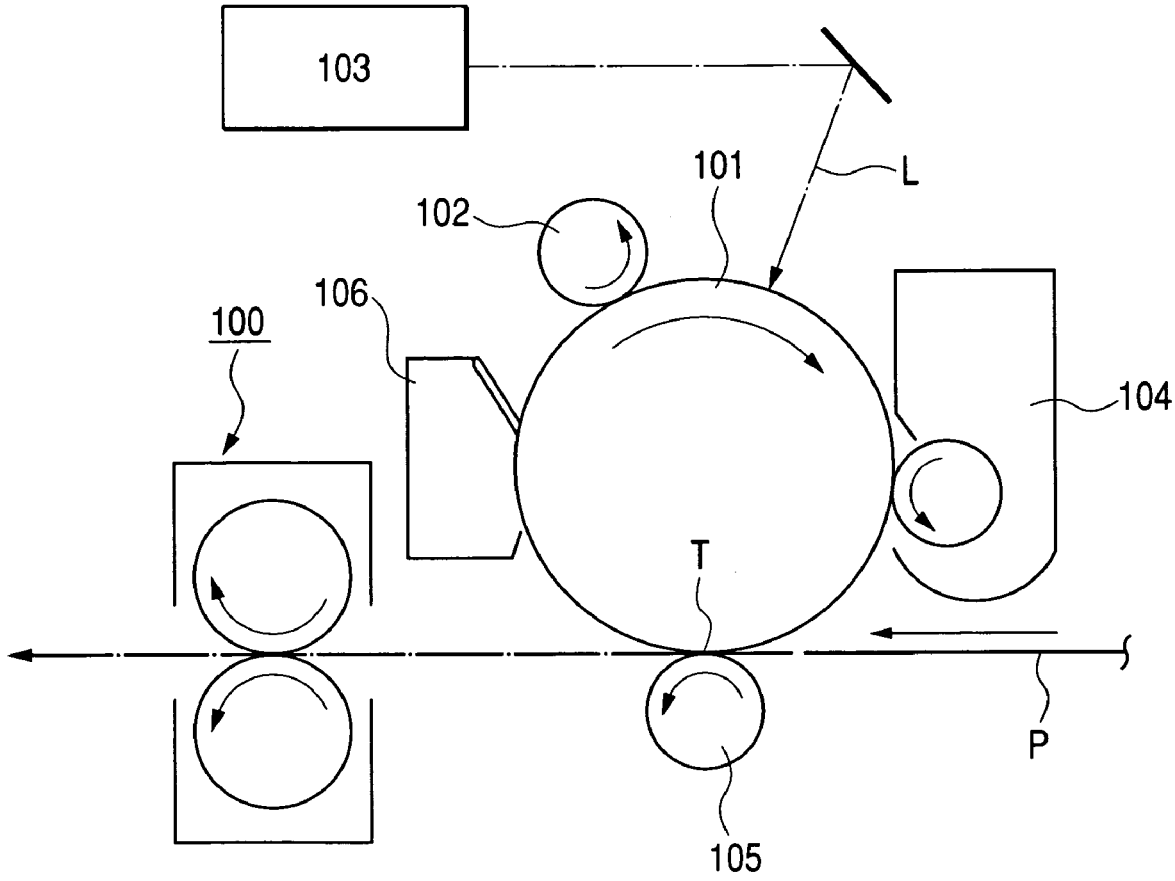
FIG. 1 is a model view schematically showing the construction of an example of an image forming apparatus.

A fixing apparatus used in an image forming apparatus will hereinafter be described as an example of the heating apparatus of the present invention. FIG. 1 is a model view schematically showing the construction of an image forming apparatus in the present embodiment. The image forming apparatus of the present embodiment is a laser printer utilizing a transfer type electrophotographic process.

The reference numeral 101 designates a rotary drum-shaped electrophotographic photosensitive member (hereinafter referred to as the photosensitive drum) as an image bearing member, which is rotatively driven at a predetermined peripheral speed in the clockwise direction of arrow.

The reference numeral 102 denotes a charging roller as charging means which uniformly charges the outer peripheral surface of the rotating photosensitive drum 101 to a predetermined polarity and predetermined potential.

The reference numeral 103 designates a laser scanner which outputs a laser beam modulated correspondingly to the time-serial electrical digital pixel signal of image information, and subjects the uniformly charged surface of the rotating photosensitive drum 101 to scanning exposure L. Thereby, an electrostatic latent image corresponding to a scanning exposure pattern is formed on the surface of the photosensitive drum.

The reference numeral 104 denotes a developing apparatus, which reversal-develops or regularly develops the electrostatic latent image on the surface of the photosensitive drum as a toner image.

The reference numeral 105 designates a transfer roller as transferring means which contacts with the photosensitive drum 101 with a predetermined pressure force to thereby form a transfer nip portion T. A recording material P is fed from a sheet feeding mechanism portion (not shown) to this transfer nip portion T at predetermined control timing and is nipped by and conveyed through the transfer nip portion T. Also, a predetermined transferring bias is applied to the transfer roller 105 at predetermined control timing. Thereby, the toner image on the surface of the photosensitive drum 101 is sequentially electrostatically transferred to the surface of the recording material P being nipped by and conveyed through the transfer nip portion T.

The recording material P having left the transfer nip portion T is separated from the surface of the photosensitive drum 101 and is introduced into an image heating and fixing apparatus 100. The image heating and fixing apparatus 100 heats and fixes the unfixed toner image on the introduced recording material P as a permanently secured image, and discharges and conveys the recording material P.

The reference numeral 106 denotes a photosensitive drum cleaning device, which removes any untransferred toner on the photosensitive drum after the separation of the recording material. The surface of the photosensitive drum from which the untransferred toner has been removed and which has been cleaned is repeatedly used for image forming.

(2) Fixing Apparatus 100

1) General Construction of the Fixing Apparatus 100

Figure 2:
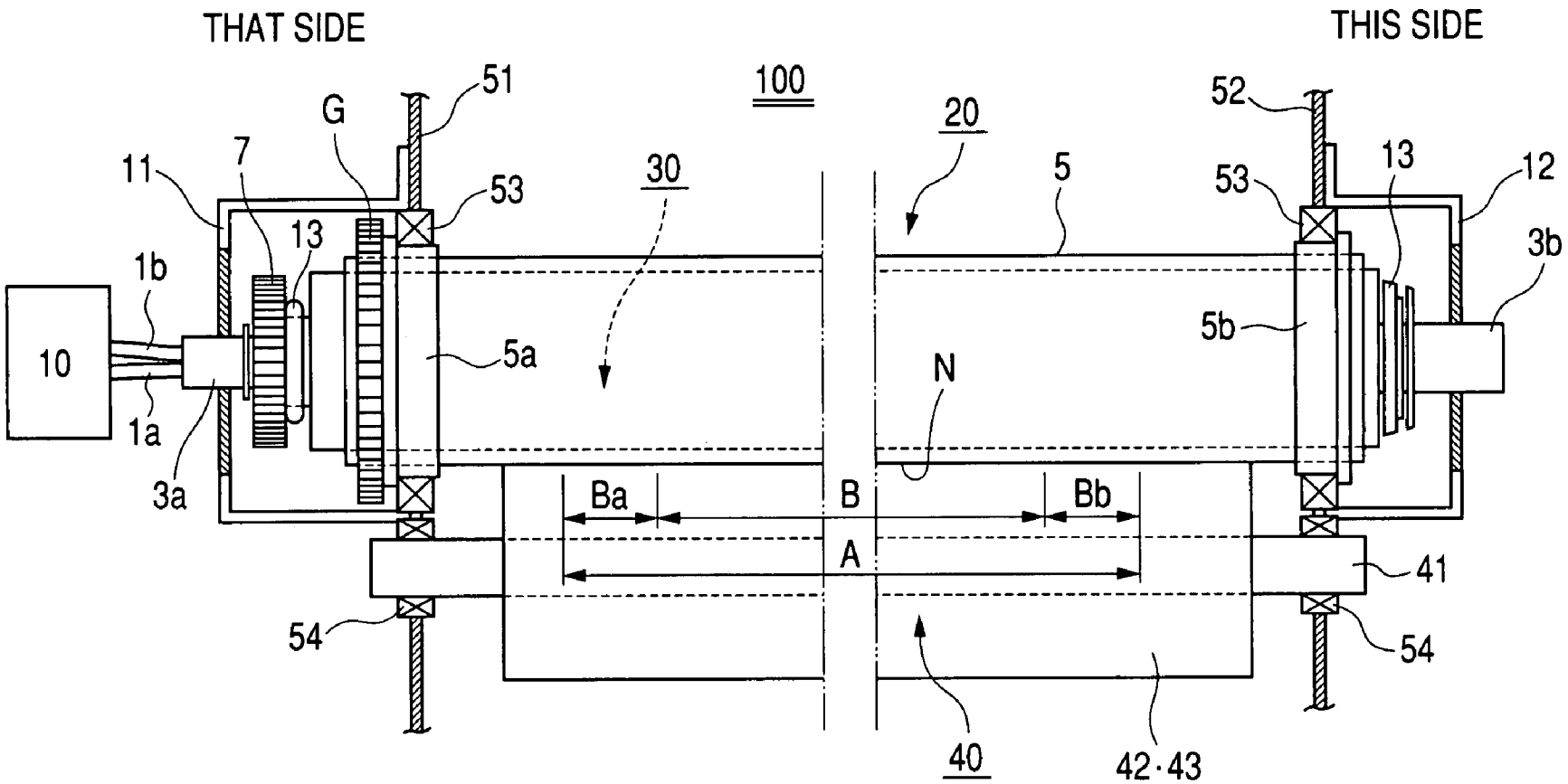
FIG. 2 is a front model view of a fixing apparatus (a heating apparatus of an electromagnetic induction heating type) with the intermediate portion thereof omitted.
Figure 4:
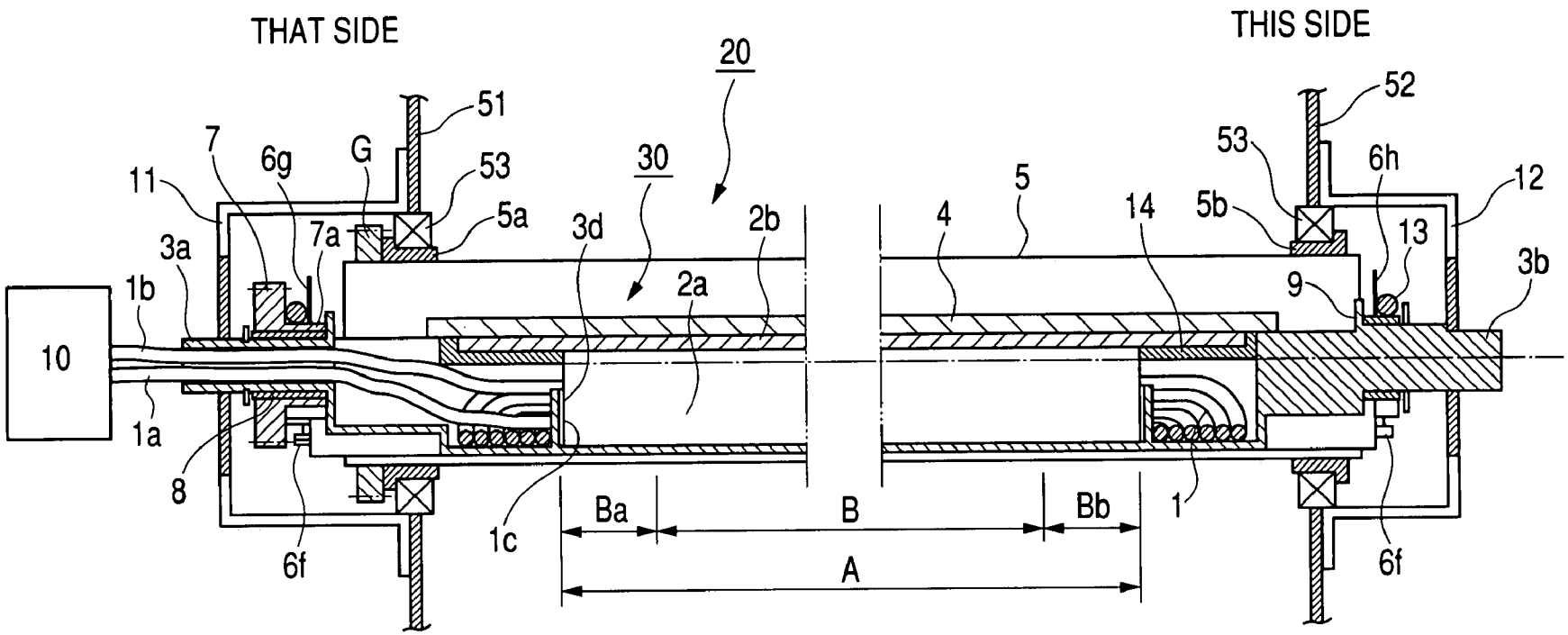
FIG. 4 is a longitudinal cross-sectional model view of a fixing roller assembly.
Figure 5:
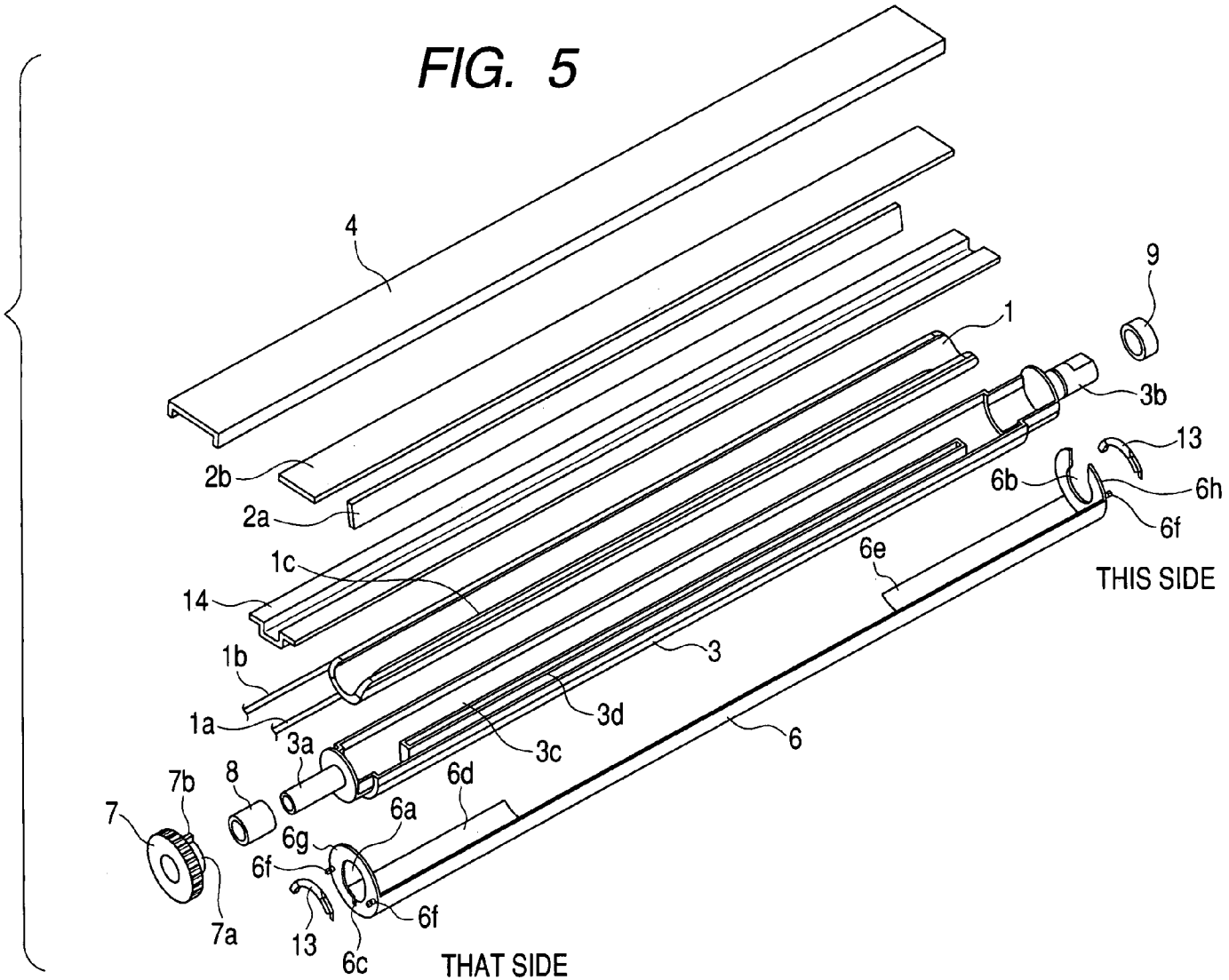
FIG. 5 is an exploded perspective model view of a magnetic flux generating assembly.
Figure 6:
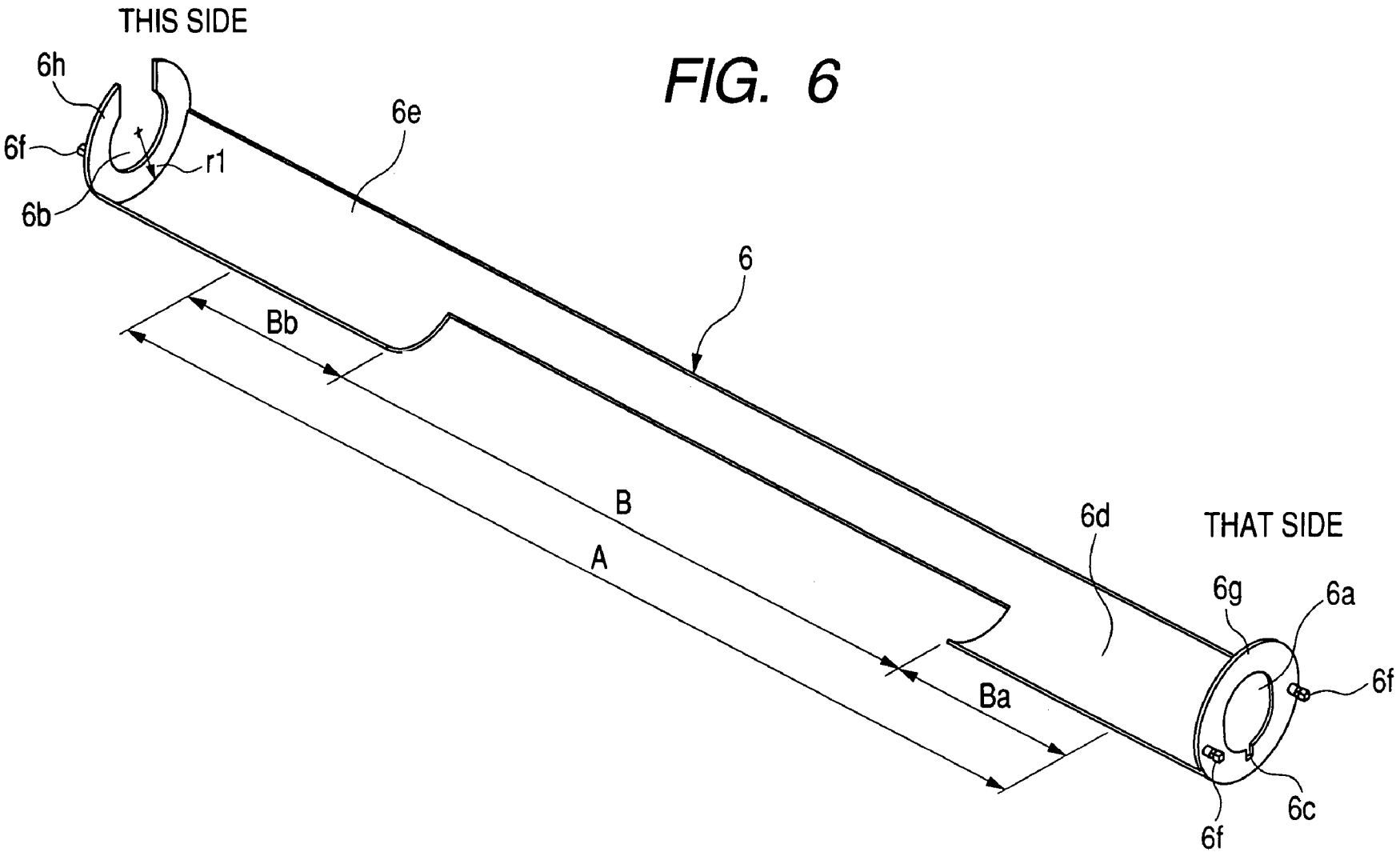
FIG. 6 is an enlarged perspective model view of a magnetic flux shield member.

The fixing apparatus 100 is a heating apparatus of an electromagnetic induction heating type according to the present invention. FIG. 2 is a front model view of the fixing apparatus 100 with the intermediate portion thereof omitted, FIG. 3 is an enlarged transverse cross-sectional model view of a portion thereof, FIG. 4 is a longitudinal cross-sectional model view of a fixing roller assembly, FIG. 5 is an exploded perspective model view of a magnetic flux generating assembly, and FIG. 6 is an enlarged perspective model view of a magnetic flux shield member.

Figure 3:
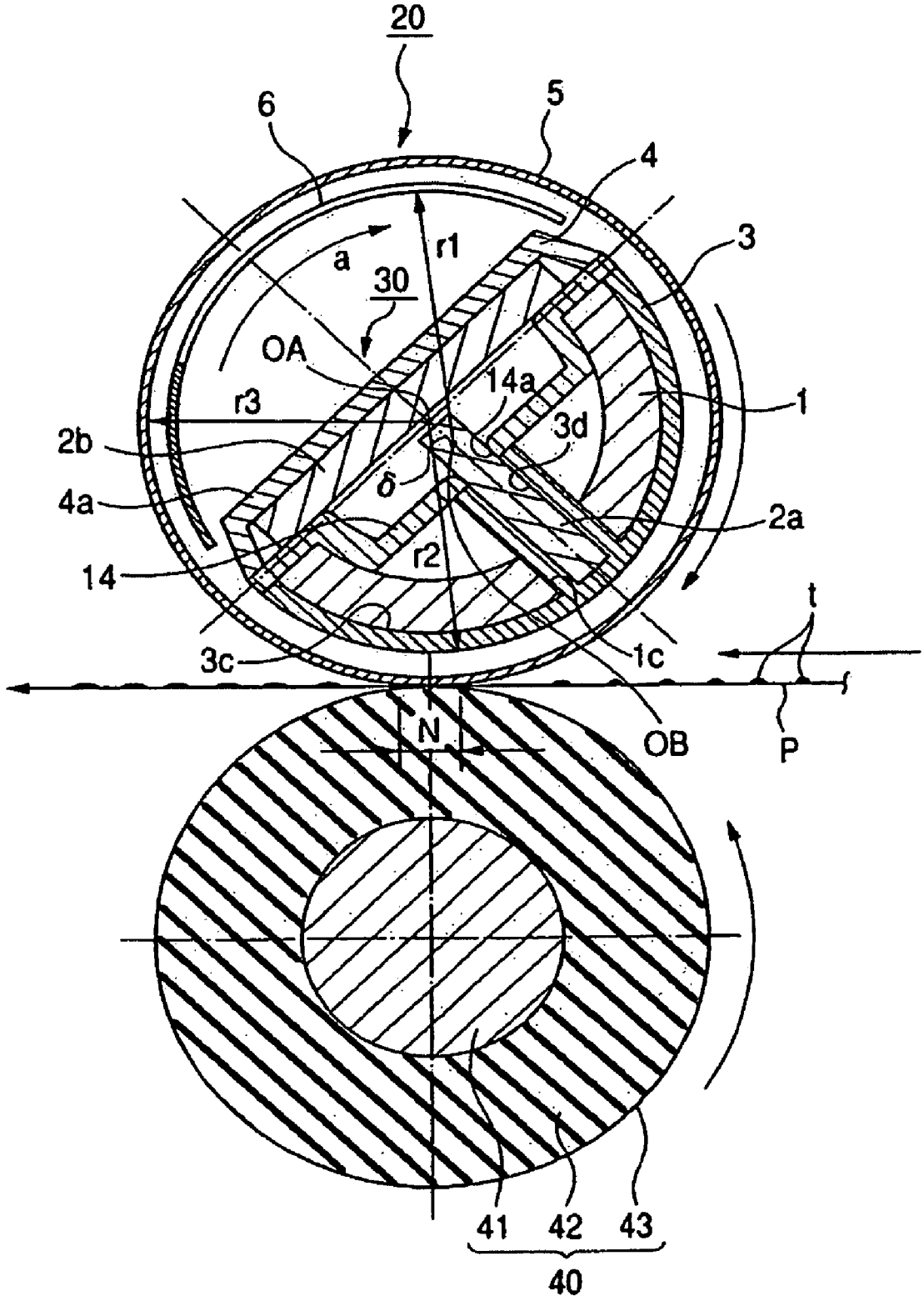
FIG. 3 is an enlarged cross-sectional model view of a portion of the fixing apparatus.

Referring chiefly to FIGS. 2 and 3, the reference numeral 20 designates a fixing roller assembly as a first fixing member, and it has a cylindrical fixing roller (sleeve) 5 as an inductive heat generating member (heat generating member) which electromagnetically inductively generates heat, and a magnetic flux generating assembly 30 as magnetic flux generating means inserted and disposed in the hollow of the fixing roller 5.

The cylindrical fixing roller 5 as the inductive heat generating member is for example, a thin-walled single sleeve of a ferromagnetic material such as nickel, iron, ferromagnetic SUS or nickel-cobalt alloy having a thickness of e.g. 300 μm, or a compound layer sleeve including the metallic layer, and slip rings 5*a* and 5*b* are fitted and secured onto the end portions on that side (deep side) and this side (front side), respectively, and the slip rings 5*a* and 5*b* are disposed while being rotatably supported on side plates 51 and 52 on that side and this side of the fixing apparatus through bearing members 53.

The fixing roller 5 uses a ferromagnetic metal (a metal of high permeability) such as iron and can thereby cause a magnetic flux generated from the magnetic flux generating means to be more restrained in the interior of the metal. That is, the density of the magnetic flux can be heightened, whereby an eddy current can be efficiently generated in the surface of the metal.

The magnetic flux generating assembly 30 is inserted into the hollow of the fixing roller 5 and shaft portions 3*a* and 3*b* on that side (deep side) and this side (front side) thereof are fixedly supported between holder supporting members 11 and 12 on that side and this side respectively, of the fixing apparatus, whereby it is disposed in the fixing roller 5 in a predetermined angular posture in non-contact with the inner surface of the fixing roller with a predetermined interval therebetween.

The reference numeral 40 denotes an elastic pressure roller as a second fixing member. This elastic pressure roller 40 comprises a mandrel (cored bar) 41, a heat-resistant elastic material layer 42 and a mold releasable surface layer 43, and is arranged under the fixing roller assembly 20 in parallelism to the fixing roller and is disposed with the end portions of the mandrel 41 on that side and this side thereof rotatably supported between side plates 51 and 52 on that side and this side of the fixing apparatus through bearing members 54 and 54. The bearing members 54 and 54 are disposed for movement relative to the side plates 51 and 52 in a direction toward the fixing roller 5, and these bearing members 54 and 54 are upwardly biased by biasing means such as a pressure spring (not shown), whereby the elastic pressure roller 40 is brought into pressure contact with the underside portion of the fixing roller 5 with a predetermined pressure force against the elasticity of the elastic material layer 42 to thereby form a fixing nip portion (heating nip portion) N of a predetermined width.

The letter G designates a fixing roller driving gear fitted and secured onto the end portion of the fixing roller 5 on that side thereof. A driving force is transmitted from a drive source side (not shown) to this gear G, whereby the fixing roller 5 is rotatively driven at a predetermined peripheral speed in a clockwise direction as viewed in FIG. 3. With this rotative driving of the fixing roller 5, rotational torque acts on the elastic pressure roller 40 in the fixing nip portion N due to a frictional force and the elastic pressure roller 40 is driven to rotate.

Also, the fixing roller 5 rises in temperature due to heat generation by an eddy current generated in the fixing roller 5 by a magnetic field (a high-frequency magnetic field) generated by a high-frequency current of e.g. 20 kHz–500 kHz being supplied from an electric power control device 10 (excitation circuit) to an exciting coil 1 in the magnetic flux generating assembly 30 which will be described later. The temperature of this fixing roller 5 is detected by a temperature detecting element (not shown) such as a thermistor, and the detected temperature information is inputted to a control circuit portion (CPU), not shown. The control circuit portion controls electric power supply from the electric power control device 10 to the exciting coil 1 to thereby control the temperature of the fixing roller 5 so that the detected temperature of the fixing roller 5 inputted from the temperature detecting element may be maintained at a predetermined fixing temperature.

In this state, the recording material P as a material to be heated on which an unfixed toner image t is formed and borne is introduced form an image forming means portion side into the fixing nip portion N, and is nipped by and conveyed through the fixing nip portion N, whereby the unfixed toner image t is fixed on the surface of the recording material P by the heat of the fixing roller 5 and the pressure force of the fixing nip portion N.

In FIGS. 2 and 4, the letter A indicates the maximum paper passing width of the recording material (paper) to the apparatus, and it corresponds to a paper size width (maximum paper passing size) for which the temperature rise of a non-paper supply portion does not occur. The letter B corresponds to the paper passing width (small size paper passing width) of a recording material having a width smaller than the paper size width A. In the image forming apparatus of the present embodiment, it is to be understood that the passing of the recording material is done by center standard conveyance. The letters Ba and Bb indicate non-paper passing areas occurring when a paper size width B which is a small size recording material is supplied, and they are difference areas from the maximum paper passing width A of a recording material of a maximum paper passing width.

2) Construction of the Magnetic Flux Generating Assembly 30

Reference is now had chiefly to FIGS. 3 to 6 to describe the construction of the magnetic flux generating assembly 30 in detail.

The magnetic flux generating assembly 30 in the present embodiment is an assembly of a holder (outer case member) 3, the exciting coil (hereinafter simply referred to as the coil) 1, an intermediate lid 14, a first magnetic material core (hereinafter simply referred to as the core) 2*a*, a second core 2*b*, a holder lid 4, a magnetic flux shield member 6, etc.

(1) Holder 3

The holder 3 is provided with the function of holding the coil 1, the first core 2*a* and the second core 2*b*, and the function of rotatably supporting the magnetic flux shield member 6, and is of a tough shape having a semicircular cross section and having an outer diameter a little smaller than the inner diameter of the fixing roller 5, and is disposed along the inner surface of the fixing roller 5, and has its inner bottom surface made into a holding portion 3*c* bearing the function of holding the coil 1, and in the central portion of the holding portion 3*c*, along the length of the holder, there is formed a sideways long core insertion slot 3*d* in which the first core 2*a* which will be described later is inserted and set. The end portions of the holder 3 on that side and this side thereof are of shaft shapes 3*a* and 3*b* for pivotally movably supporting the magnetic flux shield member 6.

In the present embodiment, this holder 3 is a molded member of glass added to PPS resin having both a heat resisting property and mechanical strength. Of course, it is non-magnetic. If the holder 3 is of a magnetic material, the holder generates heat by electromagnetic induction and the heat generating efficiency of the fixing roller 5 drops.

A material such as PPS resin, PEEK resin, polyimide resin, polyamide resin, polyamideimide resin, ceramics, liquid crystal polymer or fluorine resin is suitable for the holder 3.

(2) Coil 1

The coil 1 must be one generating a sufficient alternating magnetic flux to heating, but for that purpose, it is necessary to make a resistance component low and make an inductance component high. As the core wire of the coil 1, use is made of a litz wire comprising about 80 to 160 thin wires of Φ0.1–0.3 bundled. As the thin wires, use is made of insulative coated electric wires. Also, use is made of a coil 1 constituted by being wound into a sideways long boat shape 8 to 12 times in accordance with the shape of the inner bottom surface of the holder 3 so as to make a round about the first core 2*a*.

The central position of this sideways long boat-shaped coil 1 is in a sideways long slot portion 1*c*, which is made to correspond to the configuration of the core insertion slot portion 3*d* in the inner bottom surface of the holder 3.

The coil 1 is fitted and set in a coil holding portion 3*c* which is the inner bottom surface of the holder 3 in a state in which the sideways long slot portion 1*c* is fitted correspondingly to the core insertion slot portion 3*d*. The reference characters 1*a* and 1*b* designate the two coil supply wires (draw-out lead wires) of the coil 1, and these are drawn out to the outside of the holder 3 through a hollow pipe-shaped (cylindrical) shaft portion 3*a* on that side of the holder 3.

(3) Intermediate Lid 14

The intermediate lid 14 is a molded member of resin or a non-magnetic metal magnetically free of influence, and is restrained and fixed over the opening portion of the holder 3 set with the coil 1 fitted therein as described above.

The central surface portion of this intermediate lid 14 exists as a concave groove portion along the length of the intermediate lid, and the central portion of the bottom surface of this concave groove portion exists as a laterally long slit portion 14*a* along the length of the concave groove portion. This sideways long slit portion 14*a* is located correspondingly to the core insertion slot portion 3*d* of the inner bottom surface of the holder 3 in a state in which the intermediate lid 14 is put on the opening portion of the holder 3 in a predetermined manner. In the state in which the intermediate lid 14 is put on the opening portion of the holder 3 and is restrained and fixed, the coil 1 in the holder 3 is held down against and fixed to the inner bottom surface of the holder 3.

(4) The First Core 2*a* and the Second Core 2*b*

As the first core 2*a* and the second core 2*b*, use is made of plate-shaped members of a magnetic material such as ferrite or Permalloy used for the core of a transformer.

The first core 2*a* is a core disposed at the central position of the coil 1, and in the present embodiment, it is a sideways long rectangular plate having a length corresponding to the maximum paper supply width A. This is inserted from the sideways long slit portion 14*a* of the intermediate lid 14 into the core insertion slot portion 3*c* of the holder 3, whereby it is disposed at the central position of the coil 1.

The second core 2*b* is disposed outside the intermediate lid 14 and constitutes a core forming a substantially T-shaped transverse cross section with the first core 2*a* (vertical portion).

It is preferable that a material of high permeability and low residual magnetic flux density such as ferrite be used for the first core 2*a* and the second core 2*b*, but any material, which can generate a magnetic flux, can be used and the material forming these cores is not particularly restricted. The present invention does not restrict the shape and material of the cores 2*a* and 2*b*, but the first core 2*a* and the second core 2*b* may be integrally molded into a T-shape to thereby obtain the effect of the present invention.

(5) Holder Lid 4

The holder lid 4 is a molded member of resin or a non-magnetic metal magnetically free of influence, and as described above, it is put on and restrained and fixed to the intermediate lid 14 on which the first core 2*a* and the second core 2*b* are set. By the mounting of this holder lid 4, the second core 2*b* is retained against detachment. In the joint portion between the holder lid 4 and the holder, the holder lid 4 is provided with an inclined portion 4*a* as shown in FIG. 3 so that the magnetic flux shield member can be gradually inserted. While in the present embodiment, the inclined portion is depicted as a straight line, it may be a curved surface.

(6) Magnetic Flux Shield Member 6

The magnetic flux shield member 6 is a sideways long thin plate member having an arcuate transverse cross section, and as will be described later, it is of a shape in which shield portions (6*e*, 6*g*) conforming to the paper size are varied. The material of this magnetic flux shield member 6 is a non-magnetic substance of good electrical conductivity, for example, an alloy of aluminum, copper, magnesium, silver or the like.

The magnetic flux shield member 6 is disposed outside the above-described assembly of the holder 3, the coil 1, the intermediate lid 14, the first core 2*a*, the second core 2*b* and the holder lid 4 with its opposite ends supported for rotation relative to the opposite end shaft portions 3*a* and 3*b* of the holder 3.

In the present embodiment, the end portions of the magnetic flux shield member 6 on that side and this side thereof are provided with flange portions (end plate portions) 6*g* and 6*h* for holding the magnetic flux shield portions (6*e*, 6*g*), and the two flange portions are provided with an aperture portion 6*a* and a different-shaped aperture portion 6*b*, respectively. Also, the outer surfaces of the two flange portions are provided with two projected portions 6*f* at opposite positions of about 180° with each aperture portion therebetween.

The aperture portion 6*a* of the flange portion 6*g* on that side forms an oval aperture shape in a direction substantially perpendicular to a generating line linking the two projected portions 6*f* together. One end edge portion in the major axis direction of the oval aperture portion 6*a* is provided with a cut-away portion 6*c*.

The different-shaped aperture portion 6*b* of the flange portion 6*h* on this side also forms an oval aperture shape in a direction substantially perpendicular to the generating line linking the two projected portions 6*f* together.

The flange portion 6*g* on that side of the magnetic flux shield member 6 has the oval aperture portion 6*a* has the oval aperture portion 6*a* fitted on the shaft portion 3*a* on that side of the holder 3, and then has a bush 8 fitted on this shaft portion 3*a* on that side, and further has a magnetic flux shield member driving gear 7 rotatably fitted on the bush 8, and the cylindrical portion 7*a* of this gear 7 is fitted into the oval aperture portion 6*a* of the flange portion 6*g* on that side, whereby the flange portion 6*g* is fitted in and supported by the cylindrical portion 7*a* of the gear 7. The bush 8 is a member having good slidability relative to the gear 7.

In this case, in a state in which a projected portion 7*b* (FIG. 5) provided on the cylindrical portion 7*a* of the gear 7 is fitted in the cut-away portion 6*c* provided in the oval aperture portion 6*a* of the flange portion 6*g* on that side, the cylindrical portion 7*a* of the gear 7 is fitted into the oval aperture portion 6*a* of the flange portion 6*g* on that side. On the side opposite to the projected portion 7*b* of the cylindrical portion 7*a* of the gear 7, a resilient member 13 such as a spring is flexed against its resiliency and the opposite end portions thereof are hooked and restrained on the above-mentioned two projected portions, and the resilient member 13 is disposed in such a manner as to be resiliently bodily applied to the cylindrical portion 7*a* of the gear 7. Thereby a biasing force acts on the magnetic flux shield member 6 toward the center of the radius to the holder 3 by the flexure reaction force of the resilient member 13. The bush 8 and the gear 7 are retained against slip from the shaft portion 3*a* by a snap ring.

The flange portion on this side of the magnetic flux shield member 6 is fitted and supported on a bush 9 having the different-shaped aperture portion 6*b* of this flange portion fitted on the shaft portion 3*b* on this side of the holder 3. On the different shape side of the aperture portion 6*b*, the resilient member 13 such as a spring is flexed against its resiliency and the opposite end portions thereof are booked and restrained on the two projected portions 6*f* and 6*f*, and the resilient member 13 is disposed in such a manner as to be resiliently applied to the bush 9 with a belly pad state. Thereby a biasing force acts on the magnetic flux shield member 6 toward the center of the radius to the holder 3 by the flexure reaction force of the resilient member 13. The bush 9 is retained against slip from the shaft portion 3*b* by a snap ring. The bush 9 is a member having good slidability relative to the magnetic flux shield member 6.

The material of the magnetic flux shield member driving gear 7 and the bushes 8 and 9 may suitably be PPS resin, PEEK resin, polyimide resin, polyamide resin, polyamide-imide resin, ceramics, liquid crystal polymer, fluorine resin or the like. Above all, use may preferably be made of polyamideimide resin, PFA resin, PEEK resin or the like particularly good in slidability.

Thus, the magnetic flux generating assembly 30 which is an assembly of the holder 3, the coil 1, the intermediate lid 14, the first core 2*a*, the second core 2*b*, the holder lid 4, the magnetic flux shield member 6, etc. is inserted into the hollow of the fixing roller 5 rotatably supported and disposed between the side plates 51 and 52 of the image forming apparatus on that side and this side thereof with bearing members 53 interposed therebetween, and the shaft portions 3*a* and 3*b* of the holder 3 of the magnetic flux generating assembly 30 on that side and this side thereof are fixedly supported between the holder supporting members 11 and 12 of the fixing apparatus on that side and this side thereof, whereby the assembly 30 is disposed in a predetermined angular posture in non-contact with the inner surface of the fixing roller with a predetermined interval therebetween.

In the present embodiment, as shown in FIG. 3, in such an angular posture that the first core 2*a* faces obliquely downwardly at about 45° upstream of the fixing nip portion N with respect to the rotational direction of the fixing roller, the magnetic flux generating assembly 30 is disposed in the fixing roller 5 in non-contact with the inner surface of the fixing roller and substantially concentrically with the fixing roller 5.

In the present embodiment, the disposed angular posture of this magnetic flux generating assembly 30 is designed such that the shaft portion 3*b* on this side of the holder 3 of the magnetic flux generating assembly 30 side and the holder supporting member 12 on this side fit to each other in a D-shape (D-cut), whereby the holder 3 of the magnetic flux generating assembly 30 is positioned and set and fixedly maintained in the fixing roller 5 in the circumferential direction of the fixing roller.

The shaft portion 3*a* on that side of the holder 3 is of a shape serving also as the guide of coil supply wires 1*a* and 1*b* supplying electric power to the coil 1. This shaft portion 3*a* is made into a hollow pipe shape so that the coil supply wires 1*a* and 1*b* may be drawn out through the interior thereof and be connected to the electric power control device 10 to thereby supply electric power.

The fixing roller 5 is rotatively driven and therewith, the pressure roller 40 is driven to rotate, and a high-frequency current is supplied from the electric power control device 10 to the coil 1 of the magnetic flux generating assembly 30, whereby a magnetic field (a high-frequency magnetic field) is generated in the coil 1. There is formed a closed magnetic path in which the AC magnetic flux of this generated magnetic field branches off into two routes from the first core 2*a* as a magnetic path forming member disposed at the central position of the coil 1 by the second core 2*b* constituting a core having a substantially T-shaped transverse cross section with the first core 2*a*, and passes through the metal layer of the fixing roller 5 which is an inductive heat generating member, and again returns to the coil 1 via the first core 2*a*. The fixing roller 5 rises in temperature due to the heat generation by an eddy current generated in the metal layer of the fixing roller 5 in this closed magnetic path by the action of the magnetic field. The temperature of this fixing roller 5 is detected by a temperature detecting element such as a thermistor, not shown, and the detected temperature information is inputted to a control circuit portion. The control circuit portion controls electric power supply from the electric power control device 10 to the coil 1 to thereby control the temperature of the fixing roller 5 so that the detected temperature of the fixing roller 5 inputted from the temperature detecting element may be maintained at a predetermined fixing temperature.

The magnetic flux shield member 6 serves to adjust the acting magnetic flux along the lengthwise direction of the fixing roller 5 which is an inductive heat generating member from the magnetic flux generating means comprising the coil 1, the first core 2*a* and the second core 2*b*, and vary the generated heat distribution with respect to the lengthwise direction of the fixing roller 5, and for the adjustment of the magnetic flux in the lengthwise direction of the fixing roller 5, the magnetic flux shield member 6 is stepwisely stopped form moving at two values or more between the magnetic flux generating means and the inner surface of the fixing roller 5 in conformity with the recording material non-passing portion area of the fixing nip portion N, about the shaft portions 3*a* and 3*b* of the holder 3 on that side and this side thereof around the outer periphery of the holder 3, by the magnetic flux shield member driving gear 7 being rotatively driven at a predetermined control angle by driving means (not shown).

That is, when the magnetic flux shield member driving gear 7 is rotated, the rotating force thereof is transmitted to the magnetic flux shield member 6 by the projected portion 7*b* of this gear 7 and the cut-away portion 6*c* of the magnetic flux shield member 6 being fitted to each other, and the magnetic flux shield member 6 is rotated in the clockwise direction of arrow a in FIG. 3 about the shaft portions 3*a* and 3*b* of the holder 3 on that side and this side thereof around the outer periphery of the holder 3 in synchronism with the first intermittent gear 7.

As shown in FIGS. 5 and 6, the magnetic flux shield member 6 is of a shape in which the shield portions thereof conforming to the paper size are varied. Also, the magnetic flux shield member 6 pivotally moves the shield portions 6*d* and 6*e* of the varied shape thereof to the opposed portion of the first core 2*a* by an angle corresponding to the paper size, by the driving means of the magnetic flux shield member 6. By shielding a magnetic flux line passing from the first core 2*a* to the fixing roller 5, the heat generation of the portions corresponding to the non-paper supply portions Ba and Bb of the fixing roller 5 corresponding to the shield portions 6*d* and 6*e* is alleviated to thereby prevent abnormal temperature rise (the temperature rise of the non-paper passing portions).

For example, the magnetic flux adjustment of a paper size width B smaller-than the paper size width A (maximum paper supply size) which is a maximum size recording material for which the temperature rise of the non-paper supply portion does not occur is possible. In the case of a paper size of the metric system, the paper size width A is defined as A4 width (297 mm), and the paper size width B is defined as A4R width (210 mm). To which paper size the width of this shield portion is made to correspond is determined by the specification of the image forming apparatus.

As previously described, the resilient member 13 such as a spring as biasing means is hooked on the projected portions 6*f* provided on the opposite end portions of the magnetic flux shield member 6, and supports the magnetic flux shield member 6 through the cylindrical portion 7*a* of the magnetic flux shield member driving gear 7 and the bush 9. Also, the aperture portion 6*a* of one flange portion 6*g* of the magnetic flux shield member 6 forms an oval aperture shape in a direction substantially perpendicular to the generating line linking the projected portions 6*f* together, and is designed such that the biasing force acts toward the center of the radius of the holder 3. The different-shaped aperture portion 6*b* of the other flange portion 6*h* likewise forms an oval aperture shape in the direction substantially perpendicular to the generating line linking the projected portions 6*f* together and therefore, as regards the magnetic flux shield member 6, a biasing force acts toward the center of the radius relative to the holder 3.

Figure 7A:
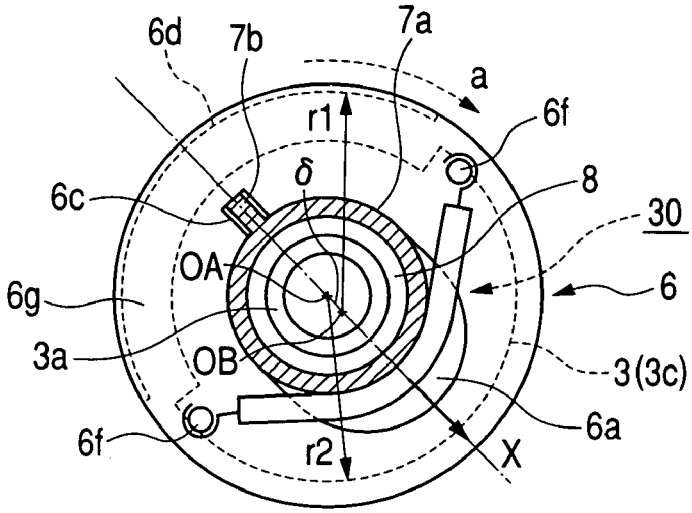
FIGS. 7A, 7B and 7C show the manner in which a holder and the magnetic flux shield member are pivotally moved while being biased by a resilient member.
Figure 7B:
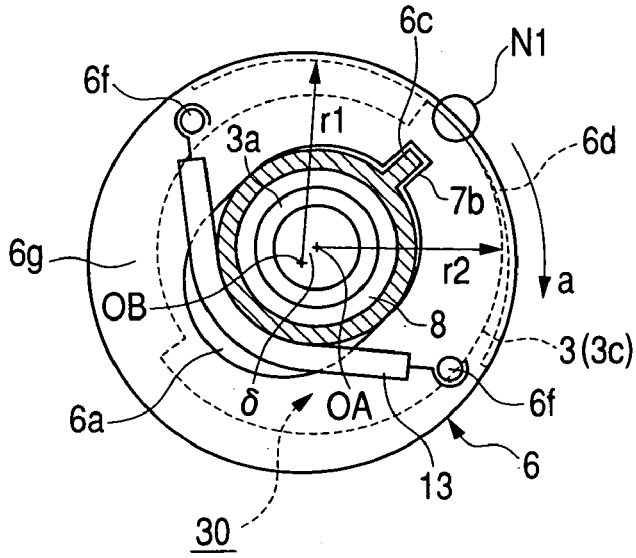
Figure 7C:
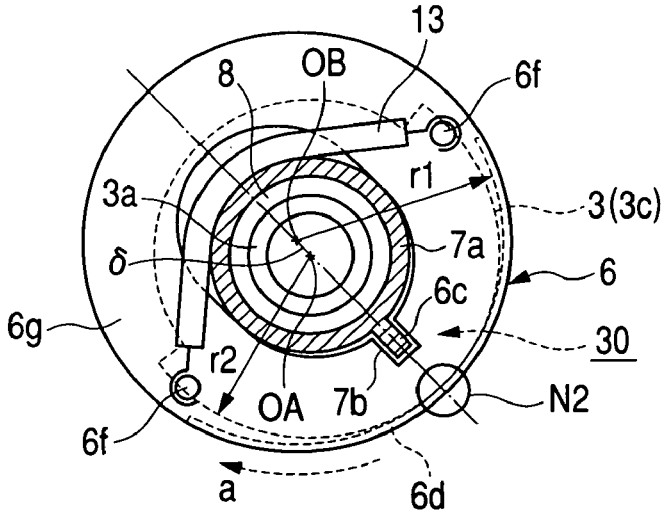

FIGS. 7A, 7B and 7C show the manner in which the holder 3 and the magnetic flux shield member 6 are biased by the resilient member 13 and yet are rotated. FIG. 7A shows a first changeover state. FIG. 7C shows a second changeover state.

FIG. 7A shows a state in which the magnetic flux shield member 6 is retracted from the magnetic flux generating means (the first changeover state). As previously described, the resilient member 13 is hooked on the projected portions 6*f* provided on the opposite end portions of the magnetic flux shield member 6, and is pulled in X direction in FIG. 7A through the cylindrical portion 7*a* of the magnetic flux shield member driving gear 7. Further, it is moved along the oval aperture 6*a* (6*b*) provided in the flange portion 6*g* (6*h*) of the end portion of the magnetic flux shield member 6 toward the center of the radius of the support shaft 3*a* of the holder 3, and the relative positional relation between the holder 3 and the magnetic flux shield member 6 is determined at a predetermined position whereat the projected portion 7*b* of the magnetic flux shield member driving gear 7 strikes against the cut-away portion 6*c* of the magnetic flux shield member 6. Here, the shapes of the aperture portion 6*a*, the different-shaped aperture portion 6*b* and the cut-away portion 6*c* provided in the flange portion which is a holding member for holding the magnetic flux shield portion are suitably adjusted in size so that the magnetic flux shield member may bear against and be supported by the holder 3 when the magnetic flux shield member is in its shielding position.

Accordingly, design is made such that in a state in which the magnetic flux shield member 6 has been rotated in the direction of arrow a by an angle corresponding to the paper size, as vibration suppressing means for the magnetic flux shield portion, the holder 3 is caused to positively bias the magnetic flux shield member 6 to thereby cause the magnetic flux shield member 6 to be contacted and supported at N1 (FIG. 7B) and N2 (FIG. 7C) by the holder 3 and be rotationally positioned between the holder 3 and the fixing roller 5, whereby an extraneous force by an alternating magnetic flux received from the magnetic flux generating means is negated by this biasing force, thus preventing the vibration sound of the magnetic flux shield member 6 from being produced. Also, as described above, the magnetic flux shield member 6 is biased relative to the direction of the major axis of the oval aperture like the aperture portion 6*a* and different-shaped aperture portion 6*b* of the magnetic flux shield member 6 by the resilient member 13 and therefore, it becomes possible to impart a state biasing force to the holder 3 without being affected by the unevenness of the mass productivity of the part concerned in biasing.

The resilient member 13 and the holder 3 also have the function of guiding the magnetic flux shield member to its shielding position, and the magnetic flux shield member is guided to a predetermined position (while being biased) toward the holder 3 side by the resilient member 13 and therefore, the risk of the magnetic flux shield member contacting with the fixing roller can be reduced, and the damage to the fixing roller by contact can also be reduced.

Also, the relation between the inner radius r1 of the shield portions 6*d* and 6*e* corresponding to the portion of contact between the holder 3 and the magnetic flux shield member 6 and the outer radius r2 of the cylindrical portion of the holder is determined so as to be $r1 \geqq r2$. Thereby, the holder 3 and the magnetic flux shield member 6 are biased and rotationally supported by line contact and therefore, the slidability of the two becomes good and it never happens that the faulty operation of the magnetic flux shield member 6 is caused.

Describing this in a little greater detail, in FIG. 3, the fixing roller 5, which is an inductive heat generating member is cylinder member having an inner radius r3 and rotated about a first center of rotation OA. Also, in FIGS. 3 and 7A to 7C, the magnetic flux generating means holding portion 3*c* of the holder 3 has a substantially cylindrical shape forming a cross-sectional shape having an outer radius r2 coaxial OA with the fixing roller 5. The magnetic flux shield member 6 has a substantially arcuate shape forming a cross-sectional shape having an inner radius r1 centering around a second center of rotation OB eccentric by δ (the inter-center distance) with respect to the first center of rotation OA, and the relation among the inner radius r3 of the fixing roller 5, the inner radius r1 of the surface of the holder 3 contacting with the magnetic flux shield member, and the outer radius r2 of the surface of the holder contacting with the magnetic flux shield member is $r3 > r1 \geqq r2$, and the inter-center distance δ between the first center of rotation OA and the second center of rotation OB is determined as $r1 - r2 \leqq \delta$.

Figure 8A:
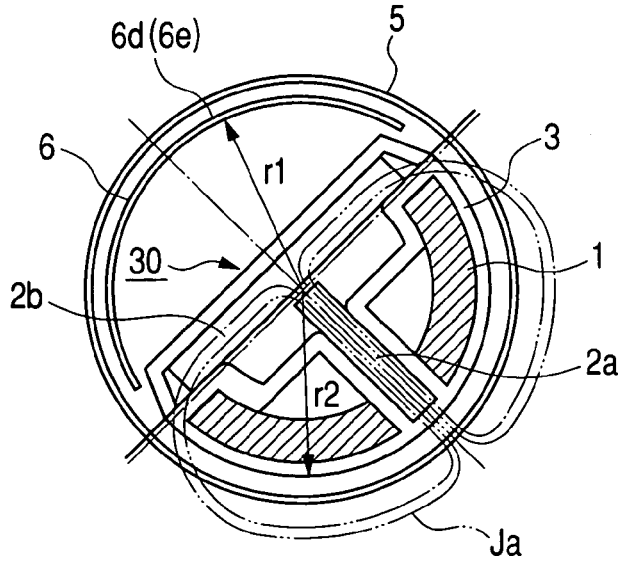
FIGS. 8A, 8B and 8C illustrate the pivotal movement of the magnetic flux shield member.
Figure 8B:
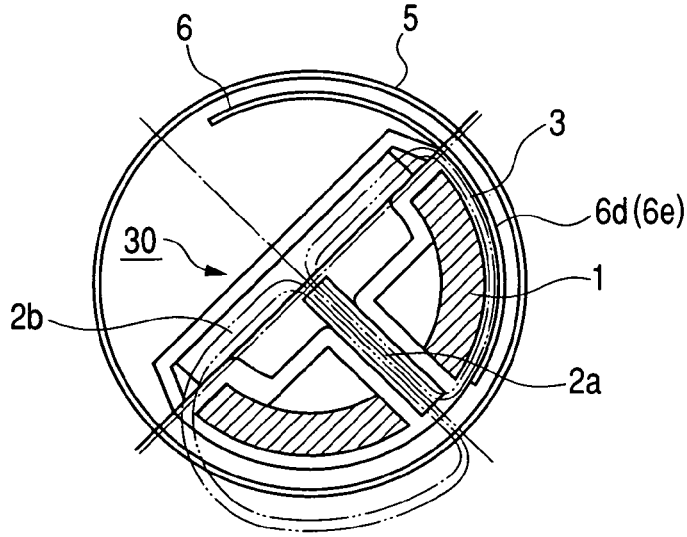
Figure 8C:
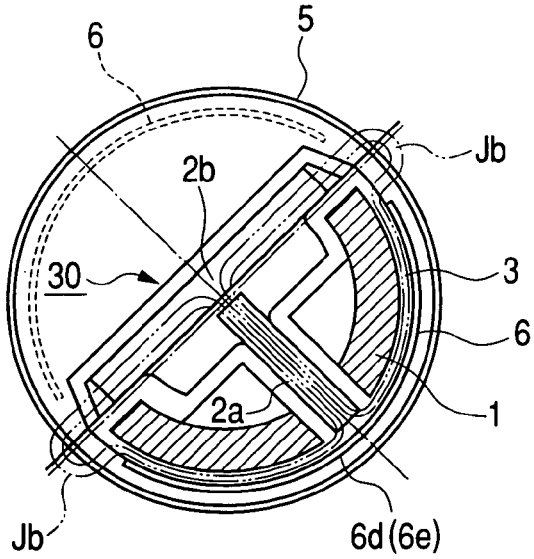

The action of the magnetic flux shield member 6 will now be described. FIGS. 8A, 8B and 8C correspond to FIGS. 7A, 7B and 7C, respectively. FIG. 8A shows a first changeover state. FIG. 8C shows a second changeover state.

FIG. 8A shows a state in which the magnetic flux shield member 6 is retracted from the magnetic flux generating means (the first changeover state). This corresponds to the stationary position of the magnetic flux shield member 6 at the paper size width A for which the temperature rise of the non-paper supply portion does not occur, and the magnetic flux shield member stands by within a range which affects little a magnetic circuit Ja. In this standby position of the magnetic flux shield member 6, fixing is possible over the entire area of the paper size width A.

Also, from the state shown in FIG. 8A, the magnetic flux shield member 6 starts to be rotated by the drive given to the magnetic flux shield member driving gear 7, and the holder 3 and the magnetic flux shield member 6 are slidingly rotated as shown in FIG. 8B, and are stopped at predetermined timing at the position of FIG. 8C whereat the shield portions 6*d* and 6*e* have been moved to a position opposed to the core 2*a* (the second changeover state). This corresponds to the stationary position of the magnetic flux shield member 6 at the paper size B for which the temperature rise of the non-paper passing portion occurs, and the magnetic flux shield member moves onto the magnetic circuit to thereby binder the flow of the magnetic flux. From a magnetic circuit Jb of widths Ba and Bb of the non-paper passing portion, it will be seen that a magnetic flux passing through the fixing portion of a width Ba (or Bb) of the non-paper passing portion of the paper size width B has become small as compared with that in FIG. 8A. Thereby, in the range of the widths Ba and Bb, the heat generation by electromagnetic induction is decreased and the temperature rise of the non-paper passing portion can be suppressed. At this time, the paper size B becomes an area capable of fixing. Also, at the magnetic flux shielding position of FIG. 8C, the magnetic flux shield member 6 is supported by the resilient member (biasing member) 13 so as to contact with the holder 3 as indicated at N2 in FIG. 7C and therefore, it becomes possible to suppress the vibration sound of the magnetic flux shield member 6 caused by an alternating magnetic flux received from the magnetic flux generating means acting on the magnetic flux shield member 6.

Figure 9:
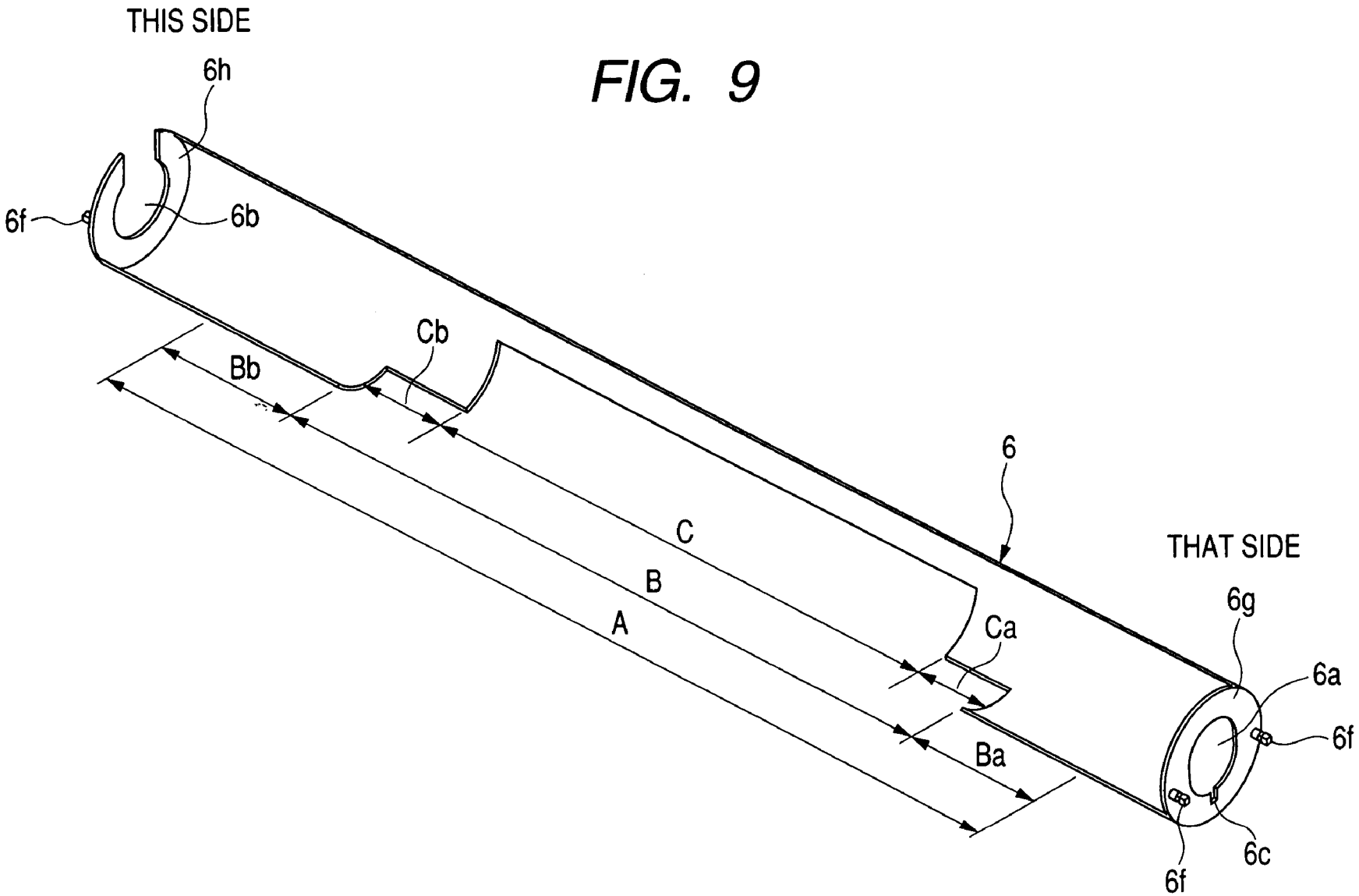
FIG. 9 is an enlarged perspective model view showing another example of the construction of the magnetic flux shield member.

Here, the magnetic flux shield portion of the magnetic flux shield member 6 is not restricted to one stage, i.e., the small paper size width B in the above-described embodiment, but as shown in FIG. 9, depending on the size for which the temperature rise of the non-paper passing portion occurs, it is possible to provide the shield portion with the size thereof varied stepwisely like paper size widths B and C, and again in such case, a similar magnetic flux shielding effect can be obtained. While in the above-described embodiment, B represents a small size paper passing width, in FIG. 9, B represents a medium size paper passing width and C represents the small size paper passing width. Ba and Bb designate non-paper passing portion areas occurring when a medium size recording material of a medium size paper passing width B is passed, and difference areas from the maximum paper passing width A. Ca and Cb denote non-paper passing portion areas occurring when a small size recording material of the small size paper passing width C, and difference areas from the medium size paper passing width B.

Second Embodiment

Biasing and sliding means for the holder 3 and the magnetic flux shield member 6, which is a second embodiment, will now be described with reference to FIGS. 10 and 11.

Figure 10:
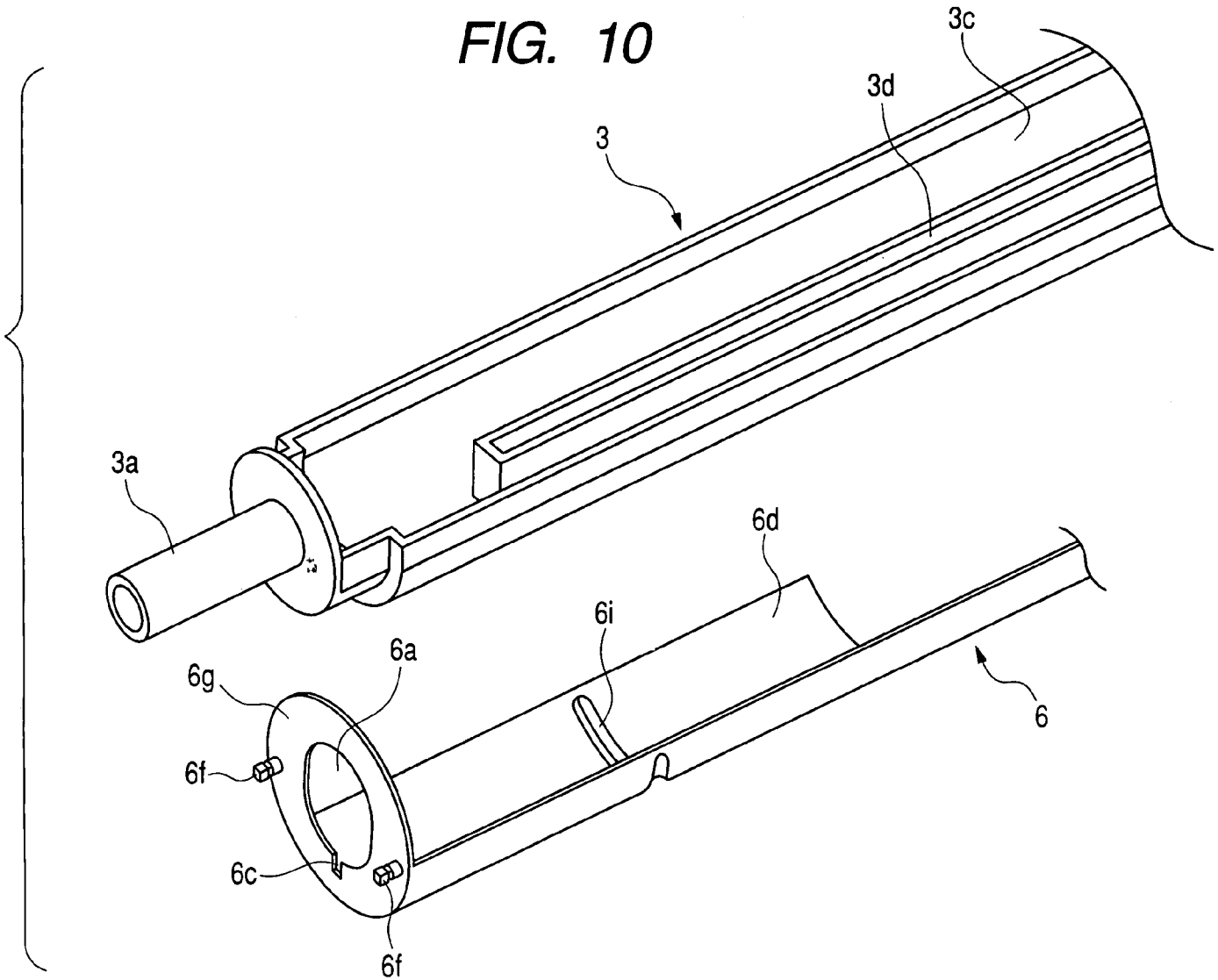
FIG. 10 is an enlarged perspective model view (I) of essential portions in a second embodiment.

In FIG. 10, a magnetic flux shield member rib 6*i* is provided on the inner surface of a cylinder portion corresponding to the shield portion 6*d* (6*e*) of the magnetic flux shield member 6, along the circumferential direction thereof. This magnetic flux shield member rib 6*i* is constituted by being biased toward and supported on the cylinder portion of the holder 3 by a resilient member (not shown). Accordingly, the holder 3 and the magnetic flux shield member rib 6*i* are supported so as to contact with each other and therefore, it become possible for the magnetic flux shield member 6 to suppress the vibration sound thereof.

Further, as compared with the rotating means for the magnetic flux shield member which is not provided with the above-described rib 6*i*, the area of contact with the holder is decreased and therefore, it becomes possible to realize a construction which is more improved in slidability and does not cause the faulty operation of the magnetic flux shield member 6.

Figure 11:
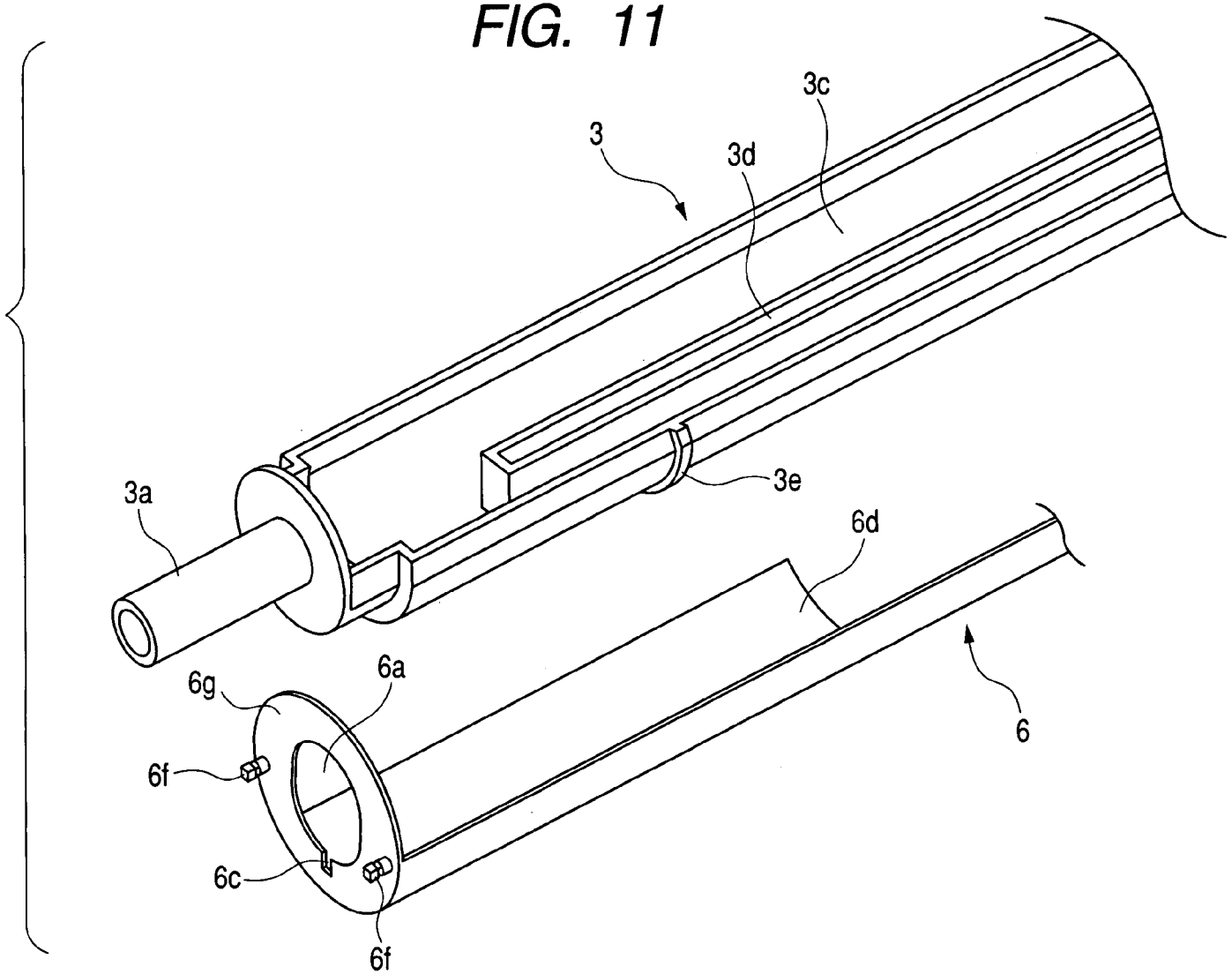
FIG. 11 is an enlarged perspective model view (II) of the essential portions in the second embodiment.

Also, as shown in FIG. 11, a circumferential rib 3*e* maybe provided on the outer peripheral surface of the cylinder of the holder 3 at a location substantially opposed to the shield portion 6*d* (6*e*) of the magnetic flux shield member 6 and may be biased toward and supported on the magnetic flux shield member 6 to thereby obtain a similar effect of slidability.

The location, length and number of the above-described rib 6*i* or 3*e* provided on the holder 3 or the magnetic flux shield member 6 are not particularly restricted.

According to the first embodiment and the second embodiment described above, it has become possible to suitably design into the predetermined relation shown above each shape biasing and supporting the magnetic flux shield member 6 rotatably disposed on the holder 3 for holding and fixing the magnetic flux generating means 1, 2, and corresponding to the surface of contact between the holder 3 and the magnetic flux shield member 6, to thereby suppress the vibration sound of the magnetic flux shield member 6 resulting from the alternating magnetic flux acting from the magnetic flux generating means 1, 2 onto the magnetic flux shield member 6, and improve the slidability of the holder 3 and the magnetic flux shield member 6, and impart the appropriate rotative driving of the magnetic flux shield member 6 corresponding to the paper size without causing the faulty operation of the magnetic flux shield member 6. Accordingly, it has become possible to stabilize the rotative movement of the magnetic flux shield member 6 with the improvement in quality by a reduction in noise and the avoidance of the faulty operation, thereby appropriately controlling the temperature rise of the non-paper passing portion of the inductive heat generating member.

Others

1) In the heating apparatus of the present invention, the form of the inductive heat generating member is not restricted to the rotary roller (sleeve) member in the embodiments, but can be other rotary member such as a belt, a moved web member or a fixed member.
2) Also, the inductive heating of the inductive heat generating member by the magnetic flux generating means is not restricted to the internal heating process in the embodiments, but can be an external heating process in which the magnetic flux generating means is disposed externally of the inductive heat generating member.
3) The present invention can also be applied to an apparatus in which the material to be heated is conveyed by one-side standard.
4) The heating apparatus of the present invention is not restricted to the use as the image heating and fixing apparatus in the embodiments, but is also effective as a tentative fixing apparatus for tentatively fixing an unfixed image on a recording material, and an image heating apparatus such as a surface quality improving apparatus for re-heating a recording material bearing a fixed image thereon to thereby improve an image surface property such as gloss. Besides these, of course, the heating apparatus of the present invention can also be effectively used as a heating apparatus for heating and processing a sheet-like member, such as, for example, a heat press apparatus for eliminating the winkles of bank notes or the like, a heat laminate apparatus, or a heating and drying apparatus for evaporating moisture contained in paper or the like.

While various examples and embodiments of the present invention have been shown and described above, those skilled in the act would understand that the purport and scope of the present invention are not restricted to the particular description made herein and the accompanying drawings, but extend to various modifications and changes all set forth in the appended claims.

What is claimed is:

1. A heating apparatus comprising:

magnetic flux generating means for generating a magnetic flux;

a heat generating member for generating heat by the magnetic flux from said magnetic flux generating means, a material to be heated being heated by the heat of said heat generating member;

a magnetic flux suppressing member for suppressing the magnetic flux from said magnetic flux generating means to said heat generating member;

moving means for moving said magnetic flux suppressing member to a suppressing position; and guide means provided between said magnetic flux generating means and said heat generating member for guiding said magnetic flux suppressing member, wherein said guide means has a sliding portion sliding with said magnetic flux suppressing member, and biasing means for biasing said magnetic flux suppressing member in a direction to closely contact with said sliding portion.

* * * * *

UNITED STATES PATENT AND TRADEMARK OFFICE

CERTIFICATE OF CORRECTION

PATENT NO. : 7,099,616 B2
APPLICATION NO. : 10/862447
DATED : August 29, 2006
INVENTOR(S) : Daijiro Kato et al.

It is certified that error appears in the above-identified patent and that said Letters Patent is hereby corrected as shown below:

COLUMN 1:
Line 48, “in” (first occurrence) should read --is--.

COLUMN 2:
Line 6, “of solving the temperature rise of the” should be deleted.
Line 7, “non-paper” should be deleted.
Line 27, “born” should read --borne--.

COLUMN 4:
Line 56, “e.g.” should read --e.g.,--.

COLUMN 5:
Line 17, “in” should be deleted.
Line 18, “parallelism” should read --parallel--.
Line 22, “members 54 and 54.” should read --members 54.--; and “members 54 and 54” should read --members 54--.
Line 25, “members 54 and 54” should read --members 54--.
Line 62, “form” should read --from--.

COLUMN 6:
Line 14, “difference” should read --different--.
Line 66, “round” should read --circle--.

COLUMN 7:
Line 65, “retained” should read --restrained--.

COLUMN 8:
Line 42, “has the” should be deleted.
Line 43, “oval aperture portion 6*a*” should be deleted.
Line 44, “bush” should read --brush--.
Line 46, “bush” should read --brush--.
Line 52, “bush” should read --brush--.

COLUMN 9:
Line 2, “bush” should read --brush--; and “retained” should read --restrained--.
Line 5, “bush” should read --brush--.
Line 11, “ports 6*f* and 6*f*,” should read --portion 6*f*--.
Line 13, “bush” should read --brush--.
Line 17, “bush” should read --brush--.
Line 18, “bush” should read --brush--.
Line 21, “bushes” should read --brushes--.

UNITED STATES PATENT AND TRADEMARK OFFICE

CERTIFICATE OF CORRECTION

PATENT NO. : 7,099,616 B2
APPLICATION NO. : 10/862447
DATED : August 29, 2006
INVENTOR(S) : Daijiro Kato et al.

It is certified that error appears in the above-identified patent and that said Letters Patent is hereby corrected as shown below:

COLUMN 9: (cont'd)
Line 30, "etc." should read --etc.,--.

COLUMN 10:
Line 37, "form" should read --from--.

COLUMN 11:
Line 4, "smaller-than" should read --smaller than--.
Line 18, "bush" should read --brush--.

COLUMN 13:
Line 11, "binder" should read --bind--.

COLUMN 14:
Line 8, "maybe" should read --may be--.
Line 17, "are" should read --is--.
Line 46, "other" should read --another--.

COLUMN 15:
Line 2, "winkles" should read --wrinkles--.
Line 8, "act" should read --art--.

Signed and Sealed this

Tenth Day of April, 2007

JON W. DUDAS
*Director of the United States Patent and Trademark Office*